US008500345B2

(12) United States Patent
Macleod et al.

(10) Patent No.: US 8,500,345 B2
(45) Date of Patent: Aug. 6, 2013

(54) ITEM HANDLING SYSTEM WITH PRINTER ALIGNMENT

(75) Inventors: Mark H. Macleod, New Milford, CT (US); John R. Masotta, Bethel, CT (US); John W. Sussmeier, Cold Spring, NY (US)

(73) Assignee: Pitney Bowes Inc., Stamford, CT (US)

( * ) Notice: Subject to any disclaimer, the term of this patent is extended or adjusted under 35 U.S.C. 154(b) by 782 days.

(21) Appl. No.: 12/650,057

(22) Filed: Dec. 30, 2009

(65) Prior Publication Data

US 2011/0155010 A1 Jun. 30, 2011

(51) Int. Cl.
*B41J 11/20* (2006.01)
*B41J 25/308* (2006.01)

(52) U.S. Cl.
USPC ..... 400/55; 347/8

(58) Field of Classification Search
USPC ..... 400/30, 55; 347/8, 19, 37
See application file for complete search history.

(56) References Cited

U.S. PATENT DOCUMENTS

| | | | | |
|---|---|---|---|---|
| 6,382,752 | B1 * | 5/2002 | Riou | 347/8 |
| 7,883,173 | B1 * | 2/2011 | Tratar et al. | 347/22 |
| 2001/0038401 | A1 * | 11/2001 | Kawase et al. | 347/42 |
| 2006/0192798 | A1 * | 8/2006 | Kuki et al. | 347/8 |
| 2007/0222803 | A1 * | 9/2007 | Don et al. | 347/8 |
| 2008/0273049 | A1 * | 11/2008 | Moon | 347/8 |

* cited by examiner

*Primary Examiner* — Ren Yan
*Assistant Examiner* — Marissa Ferguson Samreth
(74) *Attorney, Agent, or Firm* — Michael J. Cummings; Charles R. Malandra, Jr.; Steven J. Shapiro

(57) ABSTRACT

An item handling system includes a transport system defining a transport plane, a printer assembly defining a printer plane, and a printer alignment system supporting the printer assembly. The printer alignment system includes a plurality of drive elements configured to move the printer assembly. A method of aligning a printer in the item handling system includes moving the printer assembly to a limit position of the printer alignment system distal from the transport system using the drive elements, moving the printer assembly to a limit position of the printer alignment system proximate to the transport system using the drive elements, and driving each of the drive elements at a respective predetermined level to place the printer plane in a substantially parallel orientation with respect to the transport plane.

16 Claims, 3 Drawing Sheets

ITEM HANDLING SYSTEM WITH PRINTER ALIGNMENT

FIELD OF THE INVENTION

The present invention relates to an item handling system and, more particularly, to an item handling system having a printer alignment system.

BACKGROUND OF THE INVENTION

Item handling systems, such as mailpiece handling systems, for example, are known in the art. These systems include inserter systems, which create mailpieces and prepare them for mailing, as well as sorter systems, which sort completed mailpieces and direct the mailpieces to storage bins. Other types of item handling systems and related applications are known.

Inserter machines are used to create mailpieces for many different applications. Inserters contain a generally modular array of components to carry out the various processes associated with mailpiece creation. The processes include preparing documents, assembling the documents associated with a given mailpiece, adding any designated inserts, stuffing the assembly into an envelope, and printing information on the envelope.

Some inserter applications utilize ink jet printers to print the information, such as address information, advertisements, and/or a postal indicia, for example, on the face of the envelopes being processes. In those applications, which involve ink jet printing on a moving envelope, both the distance of the printer assembly from the envelope and the planarity of the printer assembly with respect to the plane of the envelope may affect the image quality. As used herein, "planarity" means the extent to which two planes are parallel. The distance and planarity of the printer assembly may have a greater effect on print quality in systems utilizing multiple print heads, such as different color print heads, for example.

Problems arising from variable distance and planarity are principally attributed to the relative low velocity of the ink droplets, as compared to the velocity of the media (e.g., envelopes). Any non-planarity of the printer assembly with respect to the moving media will result in different travel times for the ink drops that create a printed image on the media, resulting in image distortion. Any variation in distance from the design distance of the print head assembly with respect to the moving media will result in different size ink drops on the paper, resulting in image quality degradation.

SUMMARY OF EXEMPLARY ASPECTS

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

In accordance with the purpose of the invention, as embodied and broadly described herein, one aspect of the invention relates to a method of aligning a printer in an item handling system. The item handling system may comprise a transport system defining a transport plane, a printer assembly defining a printer plane, and a printer alignment system supporting the printer assembly, wherein the printer alignment system comprises a plurality of drive elements configured to move the printer assembly.

In one embodiment, the method comprises moving the printer assembly to a limit position of the printer alignment system distal from the transport system using the drive elements, moving the printer assembly to a limit position of the printer alignment system proximate to the transport system using the drive elements, and driving each of the drive elements at a respective predetermined level to place the printer plane in a substantially parallel orientation with respect to the transport plane.

As used herein, "items" include papers, documents, postcards, envelopes, brochures, enclosures, booklets, magazines, media items, including CDs, DVDs, computer disks, and/or other digital storage media, and packages having a range of sizes and materials. Further, as used herein, "level" means a relative degree of intensity. In one example, as it relates to driving the drive elements, level means a current applied to the drive elements.

In another aspect, the invention relates to an item handling system comprising a transport system defining a transport plane, a printer assembly defining a printer plane, a printer alignment system supporting the printer assembly, and a controller. The printer alignment system may comprise a plurality of drive elements configured to move the printer assembly.

In one embodiment, the controller may be configured to control the drive elements to move the printer assembly to a limit position of the printer alignment system distal from the transport system, control the drive elements to move the printer assembly to a limit position of the printer alignment system proximate to the transport system, and drive each of the drive elements at a respective predetermined level to place the printer plane in a substantially parallel orientation with respect to the transport plane.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The accompanying drawings, which are incorporated in and constitute a part of this specification, illustrate exemplary embodiments of the invention and, together with the description, serve to explain the principles of the invention. In the drawings.

DETAILED DESCRIPTION OF EXEMPLARY EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Embodiments of the printer alignment method and device according the invention will be described with reference to certain applications in mailpiece inserter systems. It should be understood, however, that embodiments of the invention may be used in association with other item handling systems configured to handle and transport mailpieces and other items.

Figure 1:
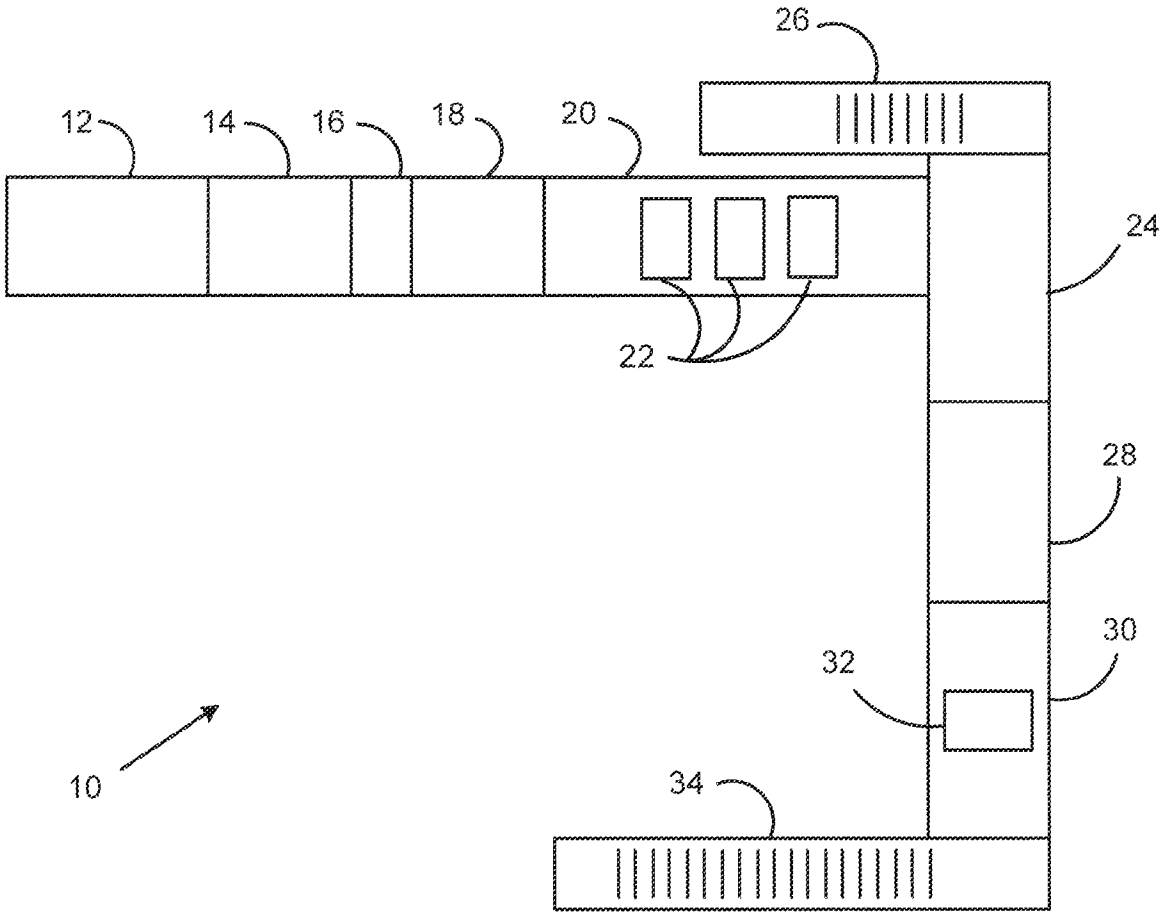
FIG. 1 is a schematic view of an item handling system utilizing an embodiment of the printer alignment system of the present invention.

A schematic view of an item handling system (e.g., inserter system) 10 incorporating elements of the invention is shown in FIG. 1. The illustrated exemplary inserter system 10 comprises a document feeder 12, which provides pre-printed documents for processing. The documents, which may comprise bills or financial statements, for example, may be provided by the document feeder 12 as individual "cut sheets," or may be cut from a spool using a web cutter (not shown).

The documents next move to an accumulator 14 and a folder 16, where the documents for respective mailpieces are assembled and folded, respectively. The folded accumulations next move to a buffer 18, which holds the accumulations for sequential processing. The accumulations next move to a chassis 20. As each accumulation moves through the chassis, inserts from a plurality of feeder modules 22 are added to the accumulation.

The accumulations next enter an insertion area 24, where the finished accumulations are stuffed into envelopes provided by an envelope hopper 26, and the envelopes are sealed. The stuffed, sealed envelopes then enter an outsort module 28, for optionally diverting defective envelopes from the production stream. Defective envelopes may have accumulations that are improperly assembled and/or may be improperly sealed, for example.

The properly assembled and sealed envelopes next enter a metering and printing area 30, where markings, such as a postage indicia and/or address information, for example, are applied at a printing station 32 to form completed mailpieces. Finally, the completed mailpieces are deposited on a conveyor 34. Other systems utilizing more or fewer components and/or different arrangements of components may also be used.

The printer alignment method and device, described below with reference to the printing station 32, may allow full-face, color printing on envelopes having a variety of thicknesses at high throughput rates.

Figure 2:
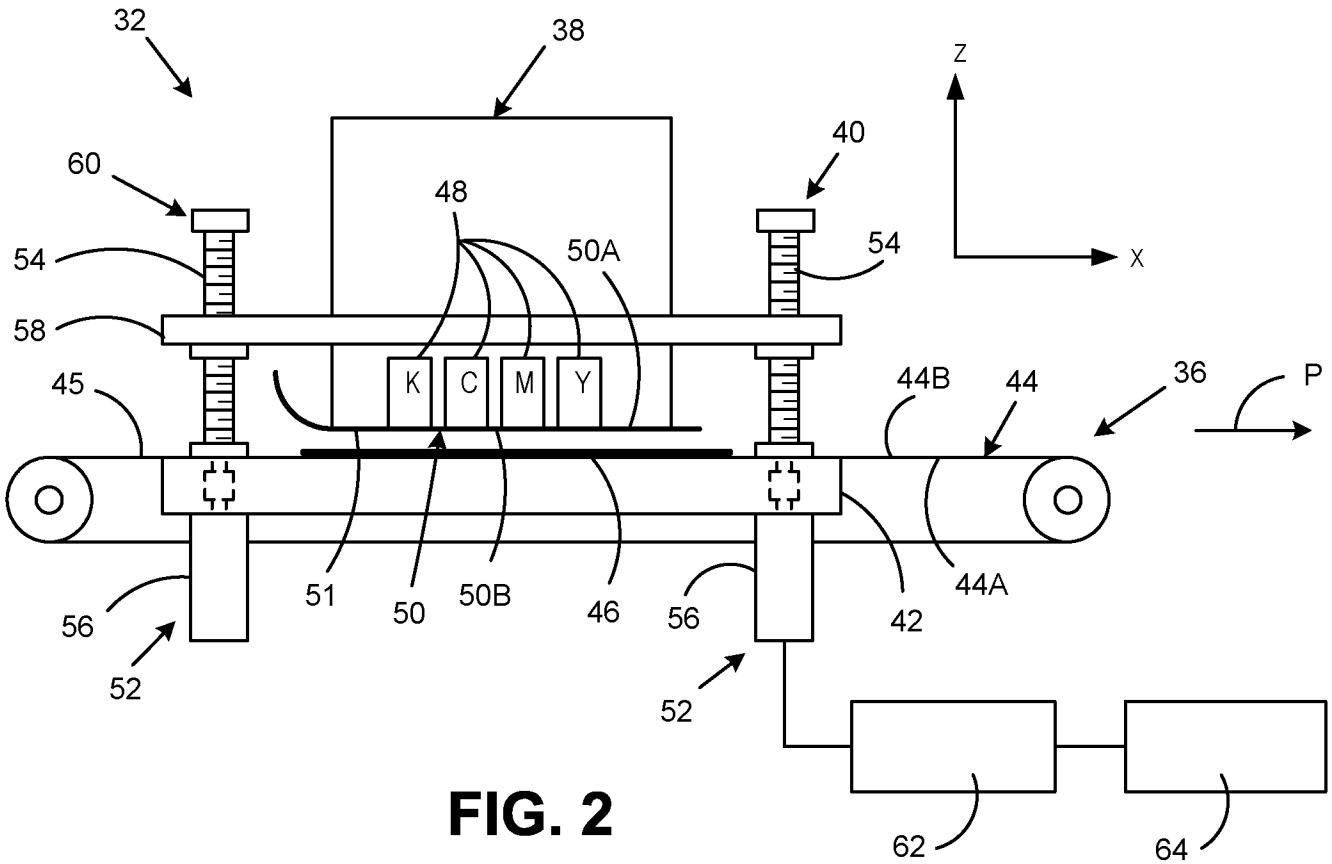
FIG. 2 is a partially schematic elevation view of a portion of the item handling system of FIG. 1.
Figure 3:
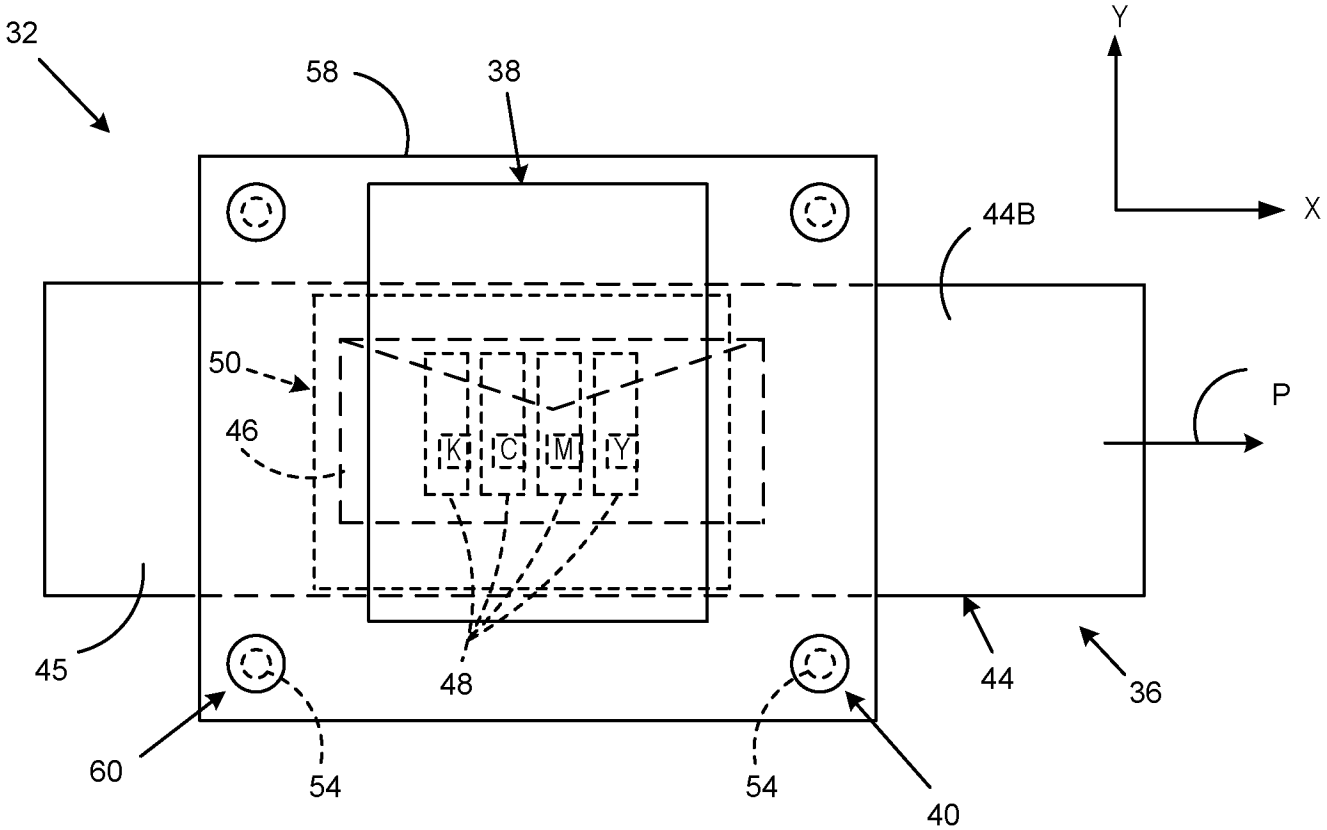
FIG. 3 is a partially schematic plan view of a portion of the item handling system of FIG. 1.

An embodiment of a printing station 32 used with the item handling system 10 is shown in FIGS. 2 and 3. As shown, the system comprises a transport system 36, a printer assembly 38, and a printer alignment system 40 supporting the printer assembly 38.

In the illustrated embodiment, the transport system 36 comprises a base 42 and a transport element 44 disposed on the base 42 configured to transport items 46 along a transport path P. In one embodiment, the transport element 44 comprises a vacuum belt. Other transport elements may also be used. Items are transported on the transport element 44 with a printed portion in the face-up orientation, which is the +Z-direction in FIG. 2. The transport element 44 has a first surface 44A adjacent to the base 42 and a second surface 44B opposite to the base 42. The second surface 44B of the transport element 44 defines a transport plane 45.

As shown in FIGS. 2 and 3, within the printer assembly 38 are four ink jet color print heads 48 (also referred to as "pens") that fire ink droplets downward at the appropriate time to create a color image on the moving media (e.g., item). The colors generally consist of K (black), C (cyan), M (magenta) and Y (yellow), but can be any combination to generate the desired print image. For example, one of the print heads may contain a florescent ink for printing postal indicia.

The bottoms of the print heads are located with high precision and accuracy to a crash plate 50. The crash plate 50 is a robust assembly that provides both an upper surface limit for a mailpiece and also provides protection to the delicate print heads 48 if such a "crash" event were to occur. In practice, the nominal distance between the print heads 48 and the bottom surface of the crash plate 50 is approximately 0.5 mm and the nominal gap between the crash plate and the envelope print surface is approximately 1 mm. If the gap is too small, the top envelope surface may rub on the crash plate and smear the ink before it has dried. If the gap is too large, image quality may be reduced because the ink droplets travel more vertical distance, becoming more dispersed and thereby decreasing print contrast.

The crash plate 50 has a first surface 50A facing a printer element 48 (i.e., the print heads) and a second surface 50B facing the transport system 36. The second surface 50B of the crash plate 50 defines a printer plane 51.

The printer alignment system 40 comprises a plurality of drive elements 52 configured to move the printer assembly 38. In one embodiment, the drive elements 52 comprise lead screw assemblies 54 coupled to servo motors 56. Other drive elements may also be used. At least three drive elements 52 may be used to orient the printer assembly 38. A system utilizing four drive elements 52 is shown in the drawings. Other numbers of drive elements may also be used.

In the illustrated embodiment, four vertically-oriented lead screw assemblies 54 are each coupled to a separate rotary servo motor 56 and are located generally on a corner of a movable sub-plate structure 58 that supports the printer assembly 38. The system may also comprise an adjustment device (not shown) allowing the printer assembly 38 to be adjusted with respect to the movable sub-plate structure 58 in the Y-direction, as shown in FIG. 3. This adjustment provides flexibility on the location that the printed image is placed on a mailpiece, for example, for specific mailing applications.

The base 42 supports both the lead screw assemblies 54 and the vacuum transport belt 44, as discussed above. The range of vertical motion for the printer assembly 38 is limited in the downward direction by the crash plate 50 contacting the vacuum belt 44 and is limited in the upward direction by the movable sub-plate 58 contacting the four upper travel limit stops 60 located on the end of the lead screw assemblies 54.

The system further comprises a controller 62 operatively connected to the drive elements 52 for providing drive signals and a processing device 64 operatively connected to the controller 62.

The method according to an embodiment of the invention may be used prior to operation of the item handling system 10 to establish planarity of the printer assembly 38 with respect to the media conveying surface (e.g., transport plane 45) beneath it.

According to one embodiment, the method comprises moving the printer assembly 38 to a limit position of the printer alignment system 40 distal from the transport system 36 using the drive elements 52, moving the printer assembly 38 to a limit position of the printer alignment system 40 proximate to the transport system 36 using the drive elements 52, and driving each of the drive elements 52 at a respective predetermined level to place the printer plane 51 in a substantially parallel orientation with respect to the transport plane 45.

In one embodiment, moving the printer assembly 38 to the limit position of the printer alignment system 40 distal from the transport system 36 comprises driving each drive element 52 at a first level to move the printer assembly 38 away from the transport system 36 to the travel limit stop 60 on the printer alignment system, driving each drive element 52 at a second level higher than the first level to apply a predetermined force on the travel limit stop 60, and driving each drive element 52 at a third level lower than the second level to maintain the printer assembly 38 at the travel limit stop 60.

For example, with reference to FIGS. 2 and 3, the first stage of planarity is achieved by driving each lead screw 54 together at the same low velocity (i.e., the first level) to translate the printer assembly 38 in an upward direction towards the upper travel limit stop location. Eventually, one corner of the movable sub-plate assembly 58 will contact the upper travel limit stop 60 and as it does, the electrical current delivered to that servo motor 56 will increase to the second level due to the increased load.

Once the current delivered to that servo motor 56 reaches a predetermined threshold value representing a known compressive force on the travel limit stop 60, the control system 62 will switch that servo over to some predetermined low current (i.e., the third level), thereby holding that area of the movable sub-plate 58 to the travel limit stop 60. The three remaining servos 56 follow the same procedure as their local sub-plate plate areas make contact with their respective travel limit stops 60. This procedure orients the printer assembly 38 roughly to the transport plane 45 to accommodate the case where the printer assembly 36 was grossly tilted before power up.

In another embodiment, moving the printer assembly 38 to the limit position of the printer alignment system 40 proximate to the transport system 36 comprises driving each drive element 52 at a fourth level to move the printer assembly 38 towards the transport system 36 so that a portion of the printer assembly 38 engages a portion of the transport system 36, driving each drive element 52 at a fifth level higher than the fourth level so that the drive element 52 applies a predetermined force on the portion of the transport system 36, and terminating a drive signal to the drive element 52.

For example, the second stage for establishing planarity is achieved, according to this embodiment, by driving each lead screw 54 together at the same low velocity (i.e., the fourth level) to translate the printer assembly 38 in a downward direction from the upper travel limit stop locations. Eventually, one corner of the crash plate 50 will contact the stationary transport element 44 and as it does, the electrical current delivered to that servo motor 56 will increase to the fifth level due to the increased load.

Once the current going to that servo motor 56 reaches a predetermined threshold value representing a known compressive force on the conveying transport 36, the control system 62 will switch that servo 56 over to zero current, thereby relieving the compressive force locally. This allows the print assembly 38 to translate slightly horizontally to overcome friction force between the crash plate 50 and the belt 44, if it is required, while the three remaining servos 56 follow the same procedure as their local crash plate areas make contact with the belt surface.

As discussed above, the method further comprises driving each of the drive elements 52 at a respective predetermined level to place the printer plane 51 in a substantially parallel orientation with respect to the transport plane 45. In one embodiment, driving each of the drive elements 52 at a respective predetermined level applies a substantially uniform pressure between the portion of the printer assembly 38 and the portion of the transport system 36. In another embodiment, the respective predetermined level is based on at least one of a weight of the printer assembly 38 and a location of a center of gravity of the printer assembly 38.

For example, the third and final stage for establishing planarity is driving the current in all four servos 56 to predetermined values to drive the crash plate 50 into the transport element 44 to provide a uniform predetermined compressive pressure across the entire crash plate surface that is in contact with the transport element 44. These values include the effects of the weight of the printer assembly 38 and are tailored to compensate for a center of gravity that is not exactly located at the geometric centroid of all 4 lead screws 54. By establishing uniform compressive pressure across the crash plate 50, the effects of a compliant rubber construction conveyor belt are compensated for.

In an embodiment, the method further comprises detecting a position of a portion of the printer assembly 38 associated with each drive element 52 and storing the positions as reference values in a processing device 64. For example, once the positions on all four servos 56 are settled, the four encoder values on each servo 56 are stored as the planar datum and are the reference for all lead screw position moves to guarantee near-perfect planarity between the printer assembly 38 and the transport belt 44.

In another embodiment, the method further comprises controlling the drive elements 52 with a substantially identical signal to position the printer assembly 38 at a desired distance from the transport system 36. In one arrangement, the desired distance is based on a thickness of an item 46 being transported by the transport system 36.

For example, the printer assembly 38 can now be lifted by the four lead screw servo motors 56, commanded in unison, to any fixed position from the referenced encoder values for fixed thickness mailing applications. For variable thickness mail, control system knowledge of the thickness of the next mailpiece is used during the mail run to adjust the height of the printer assembly 38 for each mailpiece by driving the lead screw motors in unison after the printing operation on the previous mailpiece is completed. The control system 62 may obtain such mailpiece thickness information from a data file that contains information regarding the individual mailpieces, or from information read directly from a code on the documents of the mailpieces.

In an alternative embodiment, the invention may be modified to accommodate constant thickness mailing applications at a reduced cost. The servo motors, their support electronics, and the control system, for example, may be eliminated and replaced by a hand-crank assembly. The hand-crank assembly may comprise a device to lock and couple all four lead screw assemblies together once planarity is established through some other conventional method.

In another embodiment, the hand-crank itself may be replaced with a single servo motor and required support electronics to accommodate variable thickness mailing applications. In yet another embodiment, the four lead screw assemblies may be replaced with four linear motors or a single linear motor, along with a precision linear stage to maintain planarity.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. A method of aligning a printer in an item handling system, comprising a transport system defining a transport plane, a printer assembly defining a printer plane, and a printer alignment system supporting the printer assembly, wherein the printer alignment system comprises a plurality of drive elements configured to move the printer assembly, the method comprising:

moving the printer assembly to a limit position of the printer alignment system distal from the transport system using the drive elements by performing the following substeps;

driving each drive element at a first level to move the inter assembly away from the transport system to a travel limit stop on the printer alignment system;

driving each drive element at a second level higher than the first level to apply a predetermined force on the travel limit stop; and driving each drive element at a third level lower than the second level to maintain the printer assembly at the travel limit stop;

moving the printer assembly to a limit position of the printer alignment system proximate to the transport system using the drive elements by performing the following substeps:

driving each drive element at a fourth level to move the printer assembly towards the transport system so that a portion of the printer assembly engages a portion of the transport system;

driving each drive element at a fifth level higher than the fourth level so that the drive element applies a predetermined force on the portion of the transport system; and terminating a drive signal to the drive element; and driving each of the drive elements at a respective predetermined level to place the printer plane in a substantially parallel orientation with respect to the transport plane.

2. The method of claim 1, further comprising:

detecting a position of a portion of the printer assembly associated with each drive element; and storing the positions as reference values in a processing device.

3. The method of claim 2, further comprising controlling the drive elements with a substantially identical signal to position the printer assembly at a desired distance from the transport system.

4. The method of claim 3, wherein the desired distance is based on a thickness of an item being transported by the transport system.

5. The method of claim 1, wherein driving each of the drive elements at a respective predetermined level applies a substantially uniform pressure between the portion of the printer assembly and the portion of the transport system.

6. The method of claim 1, wherein the respective predetermined level is based on at least one of a weight of the printer assembly and a location of a center of gravity of the printer assembly.

7. The method of claim 1, wherein the transport system comprises:

a base; and a transport element disposed on the base configured to transport items along a transport path, the transport element having a first surface adjacent to the base and a second surface opposite to the base, and wherein the second surface of the transport element defines the transport plane.

8. The method of claim 1, wherein the printer assembly comprises a crash plate having a first surface facing a printer element and a second surface facing the transport system, and wherein the second surface of the crash plate defines the printer plane.

9. An item handling system, comprising:

a transport system defining a transport plane;

a printer assembly defining a printer plane;

a printer alignment system supporting the printer assembly, wherein the printer alignment system comprises a plurality of drive elements configured to move the printer assembly; and a controller configured to:

control the drive elements to move the printer assembly to a limit position of the printer alignment system distal from the transport system by driving each drive element at a first level to move the printer assembly away from the transport system to a travel limit stop on the printer alignment system; driving each drive element at a second level higher than the first level to apply a predetermined force on the travel limit stop; and driving each drive element at a third level lower than the second level to maintain the printer assembly at the travel limit stop;

control the drive elements to move the printer assembly to a limit position of the printer alignment system proximate to the transport system by driving each drive element at a fourth level to move the printer assembly towards the transport system so that a portion of the printer assembly engages a portion of the transport system; driving each drive element at a fifth level higher than the fourth level so that the drive element applies a predetermined force on the portion of the transport system; and terminating a drive signal to the drive element; and drive each of the drive elements at a respective predetermined level to place the printer plane in a substantially parallel orientation with respect to the transport plane.

10. The system of claim 9, further comprising a processing device operatively connected to the controller, wherein the controller is further configured to:

detect a position of a portion of the printer assembly associated with each drive element; and store the positions as reference values in the processing device.

11. The system of claim 10, wherein the controller is further configured to control the drive elements with a substantially identical signal to position the printer assembly at a desired distance from the transport system.

12. The system of claim 11, wherein the desired distance is based on a thickness of an item being transported by the transport system.

13. The system of claim 9, wherein the controller is configured to drive each of the drive elements at a respective predetermined level by applying a substantially uniform pressure between the portion of the printer assembly and the portion of the transport system.

14. The system of claim 9, wherein the respective predetermined level is based on at least one of a weight of the printer assembly and a location of a center of gravity of the printer assembly.

15. The system of claim 9, wherein the transport system comprises:

a base; and a transport element disposed on the base configured to transport items along a transport path, the transport element having a first surface adjacent to the base and a second surface opposite to the base, and wherein the second surface of the transport element defines the transport plane.

16. The system of claim 9, wherein the printer assembly comprises a crash plate having a first surface facing a printer element and a second surface facing the transport system, and wherein the second surface of the crash plate defines the printer plane.

* * * * *